United States Patent [19]

Herbolsheimer et al.

[11] 3,938,766

[45] Feb. 17, 1976

[54] ADJUSTABLE TYPEWRITER PLATFORM MECHANISM

[75] Inventors: Bruce E. Herbolsheimer; Douglas D. Marsh, both of Auburn, Ind.

[73] Assignee: Garrett Tubular Products, Inc., Garrett, Ind.

[22] Filed: Dec. 6, 1974

[21] Appl. No.: 530,210

[52] U.S. Cl. ..... 248/23; 108/147; 312/21; 312/208

[51] Int. Cl.[2] ..... F16F 15/01; F16M 7/00

[58] Field of Search ..... 312/208, 306, 351, 21; 248/23; 108/147

[56] References Cited

UNITED STATES PATENTS

| | | | |
|---|---|---|---|
| 2,831,746 | 4/1958 | Hartnett | 108/147 |
| 2,857,225 | 10/1958 | Dombek | 108/147 X |
| 2,991,030 | 7/1961 | Herbolsheimer | 108/147 X |

*Primary Examiner*—Casmir A. Nunberg

[57] ABSTRACT

An adjustable typewriter platform mechanism is provided for use with a desk of the type having a typewriter platform recess in the desk top. The typewriter platform mechanism includes a U-shaped base plate which is horizontally mounted at a spaced distance below the desk top. Four vertically disposed jack-screws are rotatably journalled between the base plate and the desk top for nontranslational rotation; and means is provided for simultaneously rotating all of the jack-screws.

A pair of parallel spaced and horizontally disposed support-bars are mounted to respective ones of the jack-screws to receive lifting motion therefrom. Limited relative horizontal movement between the support-bars and the jack-screws is permitted in two horizontal and orthogonally intersecting axes; and means is provided for vertically guiding the support-bars in one vertical plane to minimize relative movement between the support-bars and the jack-screws in one of the aforesaid horizontal axes.

18 Claims, 14 Drawing Figures

ADJUSTABLE TYPEWRITER PLATFORM MECHANISM

BACKGROUND OF THE INVENTION

1. Field of the Invention

This invention relates generally to adjustable typewriter platform mechanisms and more particularly to an adjustable typewriter mechanism in which manufacturing problems with misalignment and relative binding between parts is effectively prevented by providing relative horizontal movement, in two orthogonally intersecting planes, between various parts of the mechanism; and vertical guides are provided to effectively minimize relative horizontal movement between the aforesaid parts in one horizontal plane whereby undue movement between the typewriter and the desk, as caused by inertial forces when returning the typewriter carriage, is effectively minimized.

2. Description of the Prior Art

In U.S. Pat. No. 2,991,030, an adjustable typewriter platform mechanism is disclosed in which a horizontally disposed base plate is mounted in spaced parallel relationship below the desk top of a desk of the type having a typewriter recess in the top thereof. A plurality of jack-screws is provided for adjustably raising and lowering a typewriter platform that is installed in the typewriter recess; and a mechanism is provided for simultaneously rotating the jack-screws.

The mechanism of the aforesaid patent provides a typewriter desk in which the height of the typerwriter can conveniently be raised or lowered to meet the requirements of optimum positioning for typists of varying statures; and the mechanism leaves the knee space under the typewriter platform clear of any mechanism which might interfere with the knee room of typists having longer length legs.

SUMMARY OF THE INVENTION

In accordance with the broader aspects of this invention, there is provided an adjustable typewriter platform mechanism for use with a desk having a desk top and having a typewriter platform recess in the desk top, the typewriter platform recess being generally disposed to coincide with a knee recess in the desk.

The typewriter platform mechanism includes a horizontally disposed U-shaped base plate having two substantially parallel and elongated sides and having a cross-member interconnecting the sides. The base plate is horizontally mounted in spaced parallel relationship below the desk top; and a plurality of vertically disposed jack-screws is rotatably journalled between the base plate and the desk top for nontranslational rotation. A pair of parallel spaced and horizontally disposed support-bars is mounted at opposite ends thereof to respective ones of the jack-screws by means of respective ones of a plurality of lift nuts.

The connection between the support-bars and the lift nuts is designed to transfer lifting motion from the jack-screws to the support-bars, to allow limited vertical motion between the support-bars and the jack-screws, and to permit limited relative horizontal movement between the support-bars and the jack-screws in two horizontal and orthogonally intersecting axes.

A pair of vertically disposed guide surfaces is positioned in close sliding relationship to the ends of the support-bars to provide vertical guiding in one vertical plane, and thereby to minimize relative horizontal movement between the support-bars and the jack-screws in one of the aforesaid horizontal axes. Finally, the mechanism includes means for simultaneously rotating all four of the jack-screws.

It is an object of this invention to provide an adjustable typewriter platform mechanism in which manufacturing problems due to misalignment and binding between relatively movable parts are effectively prevented.

It is another object of this invention to provide an adjustable typewriter platform mechanism in which relative horizontal movement in two orthogonally intersecting axes is provdied between the typewriter platform and a plurality of vertically disposed jack-screws.

It is still another object of this invention to provide an adjustable typewriter platform mechanism in which relative horizontal movement in two orthogonally intersecting axes is provided between a typewriter platform and a plurality of vertically disposed jace-screws and in which vertical guiding is provided in one vertical plane to minimize movement between the typewriter platform and the jack-screws in one of the aforesaid horizontal planes whereby relative horizontal movement between a typewriter and the top of the typewriter desk, as caused by inertial forces during carriage return, is effectively minimized.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
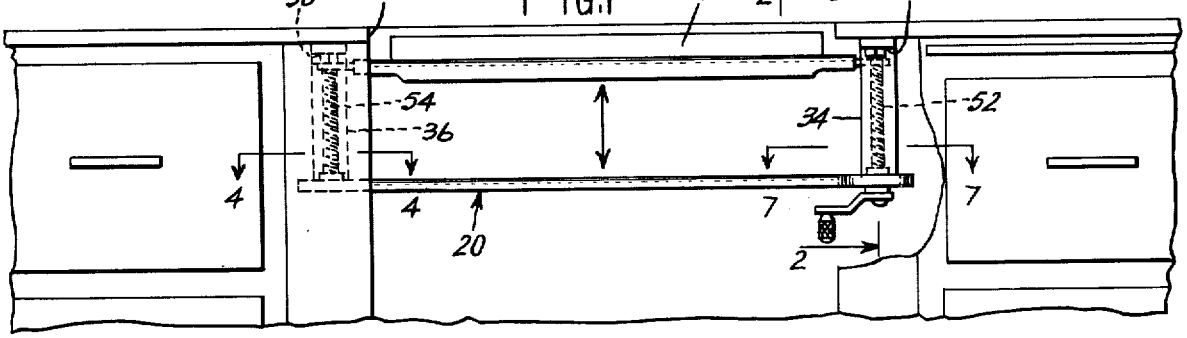
FIG. 1 is a frong elevation of one embodiment of this invention shown as being mounted on a typical desk, a portion of the desk being broken away for clarity of illustration.
Figure 2:
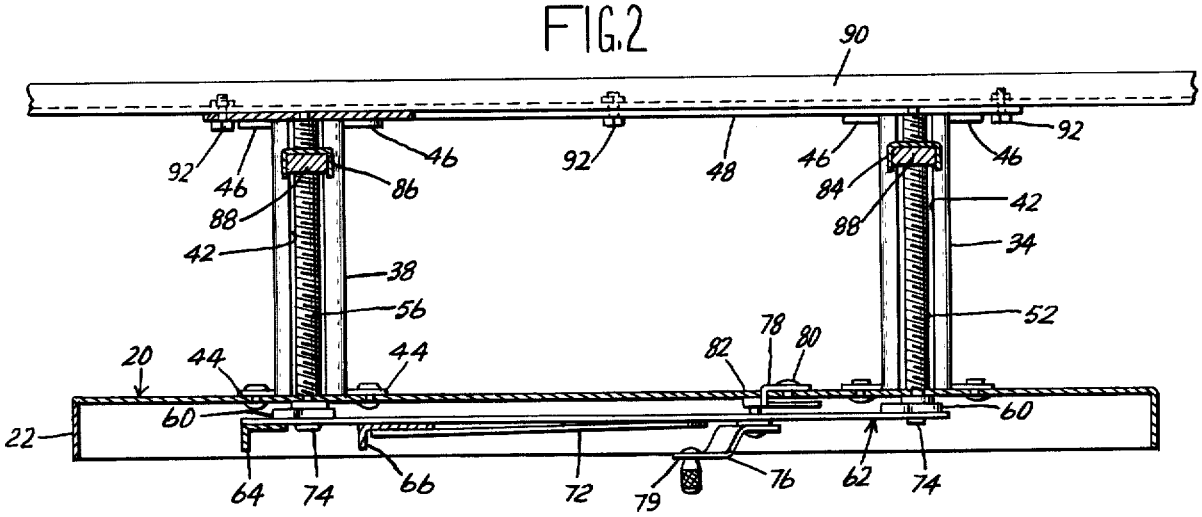
FIG. 2 is a sectional illustration taken substantially along the section line 2—2 of FIG. 1.
Figure 3:
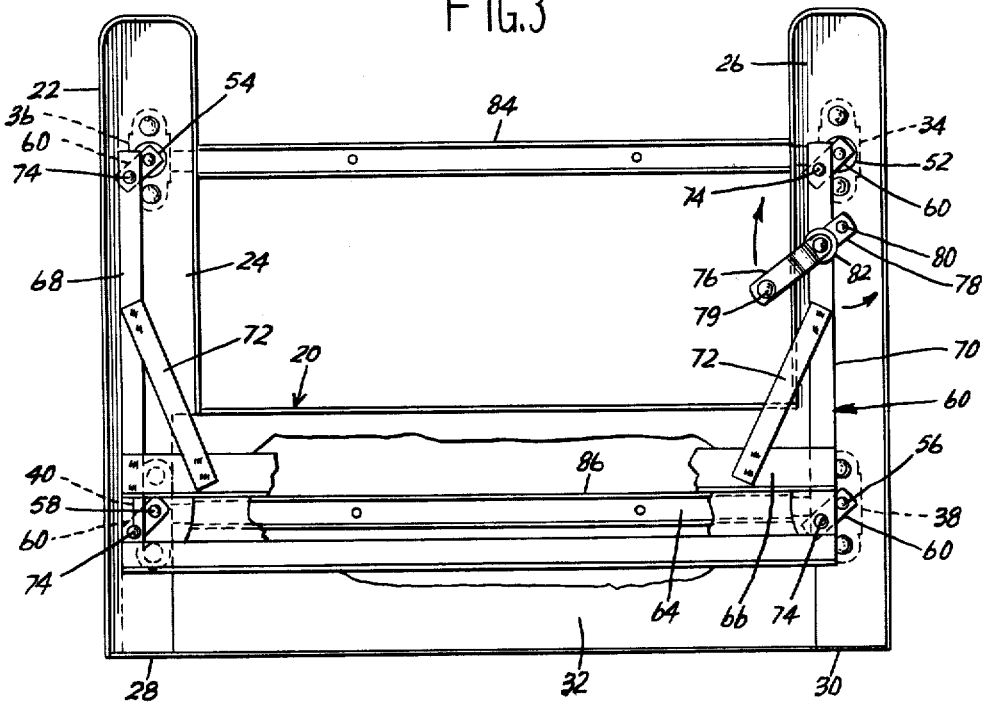
FIG. 3 is a bottom plan view of the typewriter platform of FIG. 1 also partially broken away for clarity of illustration.

Referring now to the drawings, and particularly to FIGS. 1 – 3, the adjustable typewriter platform mechanism includes a horizontally disposed U-shaped base plate 20 which is preferably fabricated from light sheet metal. The base plate 20 is substantially flat with the exception that the edges thereof are bent downward to provide a reinforcing perimetral flange 22. The two sides 24 and 26 of the base plate 20 are elongated and parallel as shown, the rear ends 28 and 30 of the respective sides being integrally connected together by a base plate cross-member 32.

Secured to the top side of the base plate 20 are four vertically disposed supporting posts 34, 36, 38, and 40. These posts are substantially identically formed such that the description of one will suffice for all. Each post is preferably fabricated of sheet metal formed to a box-like shape but with the longitudinal edges of the section of sheet metal from which the post is fabricated spaced from each other to provide a longitudinally extending vertical slot 42. The bottom and top of each post are provided with two laterally extending flanges 44 and 46, respectively, the two flanges 44 being secured to the base plate 20 by means of rivets or the like. These four posts may be considered in pairs, the two posts 34 and 36 being characterized as the front posts since they are located near the front ends of the two base plate sides 24 and 26, respectively. Similarly, the posts 38 and 40 may be characterized as the rear posts since they are located toward the rear ends of the sides 24 and 26, respectively. The slots 42 in the various posts are arranged such that the slots in the front posts 34 and 36 face each other and are parallel, as are the slots 42 in the two posts 38 and 40 with respect to each other.

Two rigid strap steel braces 48 and 50 are connected to the tops of the respective front and rear posts 34, 38, and 36, 40. The braces are attached rigidly to the respective post tops by means of rivets passing through to the flanges 46. The four posts are located with respect to each other at the four corners of an imaginary rectangle.

Mounted inside the posts 34, 36, 38, and 40 are four substantially identical and vertically disposed jack-screws 52, 54, 56 and 58, respectively, each in registering alignment with the respective ones of the slots 42. Each jack-screw is journalled at its opposite ends into the base plate 20 and into one of the two braces 48, 50, respectively, for nontranslational rotation therein. For example, the bottom end of the jack-screw 52 is journalled in a bearing aperture in the base plate 20 while the upper end thereof is journalled in a bearing aperture in the brace 48.

Figure 4:
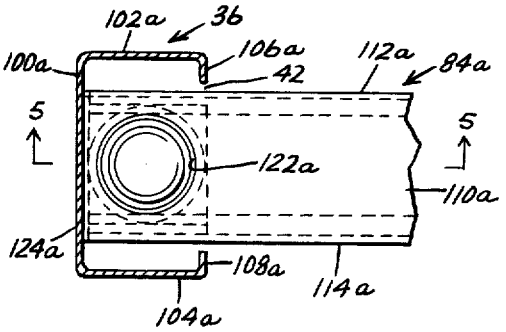
FIG. 4 is a partial cross-section taken substantially as shown by section line 4—4 of FIG. 1.

Fixedly secured to the bottom end of each jack-screw and disposed adjacent to the underside of the base plate is a flat steel operating arm 60, each arm extending radially or laterally from the respective one of the jack-screws. A U-shaped pitman or connecting rod, indicated generally by the reference numeral 62, is also located adjacent to the underside of the base plate 20 and is constructed to conform to both the size and shape of the base plate (FIG. 3). This pitman 62 must be rigidly constructed so for this reason is provided with two spaced-apart angle irons 64 and 66 as cross-members which are secured to the rear ends of two flat steel bars 68 and 70, respectively. Additional reinforcement between the cross-members 64 and 66 and the steel bars 68 and 70 is provided by the two corner braces 72 welded preferably in the positions as shown in FIGS. 3 and 4.

The pitman 62 is pivotally connected to each of the operating arms 60 as shown by means of a respective pivot pin 74, each pivot pin being spaced from the axis of the respective jack-screw. All of the operating arms 60 and the lever lengths thereof are of substantially the same length so that the pitman 62 may be rotated in a plane parallel to the base plate to rotate all of the jack-screws in unison. Operation of the pitman 62 is accomplished by means of a crank 76 composed of a first link 78 pivoted at one end by means of a pivot pin 80 to the base plate 20 and fixedly secured at the other end to a pin 82 which projects through the bar 70 of the pitman. A lower end of the pin 82 as viewed in FIG. 2 is fastened securely to a handle portion 79 of the crank 76 as shown. The opening in the bar 70 which accomodates the pin 82 is a large enough to provide for a rotational connection therewith. By disposing the pivot pin 80 on a straight line which intersects the axes of the front and rear screws 52 and 56, and by further locating the pin 82 from the pin 80 at a distance equal to the operating lengths of the individual arms 60, the crank 76 may be rotated to impart a rotational motion to the pitman 62 for rotating all of the jack-screws in unison.

Two elongated support-bars 84 and 86, preferably formed of channel-shaped steel, are threadably mounted at the oppostite ends thereof to the front pair, 52 and 54, and the rear pair, 56 and 58, of the jack-screws respectively. Each support-bar has secured at its opposite end a lift nut 88. Each of the lift nuts 88 has a threaded aperture which is threadably mounted onto the respective ones of the jack-screws. By locating the support-bars 84 and 86 equal distances above the base plate 20 to start with, rotation of the four jack-screws in unison will serve to raise or to lower the support-bars in unison depending upon the direction of jack-screw rotation.

FIG. 1 illustrates the mechanism thus far being described as being fastened to an ordinary typewriter desk having a typewriter platform recess 90. The illustrated method of securing the mechanism to the desk is shown more clearly in FIG. 2, suitable bolts or screws 92 being used to clamp the braces 48 and 50 to the underside of the desk top on opposite sides, respectively, of the typewriter platform recess 90. As shown in FIG. 2, three such screws are used for the purpose. By this means of fastening, the mechanism is in effect suspended from the under side of the desk top in registration with the typewriter platform recess 90. The two support-bars 84 and 86 constitute a platform support on which a typewriter may be placed, such a typewriter platform 94 being in one embodiment a rigid, flat board of wood or plastic composition secured to the support-bars 84 and 86. By rotating the crank 76, all of the jack-screws will be rotated in unison, thereby moving the support-bars 84 and 86 and platform 94 upwardly or downwardly as the case may be. A typewriter (not shown) typically rests on the platform 94.

An important feature of this invention resides in the fact that the front portion of the mechanism is completely open, this being accomplished by providing the base plate 20 and the pitman 62 with a U-shape. Since the typist's knees are located underneath the base plate 20, it becomes obvious that nothing in the forward or front portion of the base plate can interfere with or contact the typist's knees. The lowest structure adjacent to the front end of the mechanism is the support-bar 84; and, for a tall person requiring more knee space, this additional knee space is automatically provided when the person adjusts the typewriter platform to the necessary height for comfortable typing. Thus, by means of a single adjustment, more knee room is provided for the taller person when the typewriter height is adjusted to the proper level.

Referring now to FIGS. 4 – 13, salient details of construction of the present invention will be described. More particularly, referring to FIGS. 4 – 6, in a first embodiment of the invention, the vertically disposed supporting posts 34, 36, 38, 40, using post 36 as an example, includes an upstanding web 100*a*, a pair of upstanding flanges 102*a* and 104*a*, and a pair of secondary flanges 106*a* and 108*a* which are spaced apart to provide the slot 42.

Each support-bar 84*a* includes an elongated web 110*a* having a pair of side flanges 112*a* and 114*a* extending orthogonally from the elongated edges of the elongated web 110*a*. The support-bar 84*a* further includes a pair of retaining flanges 116*a* and 118*a* at each end which extend inwardly from the side flanges 112*a* and 114*a* respectively and which leave a slot 120*a* between the retaining flanges 116*a* and 118*a*.

The support-bar 84*a* also includes a hole 122*a* which is proximal to an end 124*a* of the support-bar 84*a*, the end 124*a* being closely spaced from or in very light sliding engagement with the web 100*a* of the supporting post 36.

A hexagonally shaped lift nut 88*a* is fitted into the end 124*a* of the support-bar 84*a*, the lift nut 88*a* including a pair of parallel surfaces 126*a* and 128*a* that are interposed between the side flanges 112*a* and 114*a*. The lift nut 88*a* also includes a retaining surface 130*a* which is in bearing engagement with the retaining flanges 116*a* and 118*a*.

Figure 5:
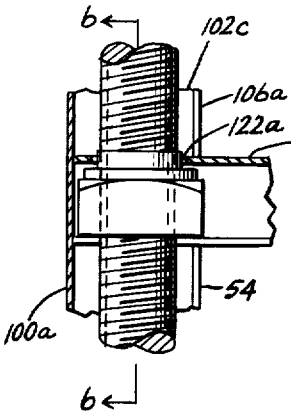
FIG. 5 is a partial cross-section taken substantially as shown by section line 5—5 of FIG. 4.
Figure 6:
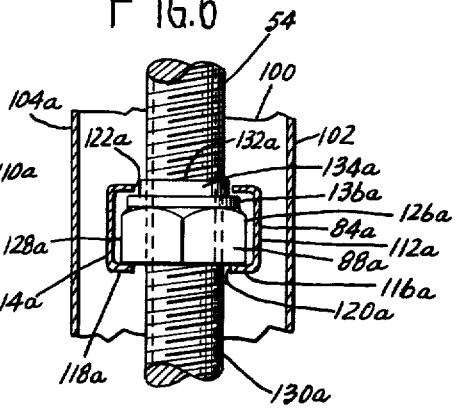
FIG. 6 is a partial cross-section taken substantially as shown by section line 6—6 of FIG. 5.

Interposed between the lift nut 88*a* and the web 110*a*, is a shouldered bushing 132*a*. The shouldered bushing 132*a* includes a bushing body portion 134*a* which is cylindrical in shape and which is sized with the hole 122*a* to permit relative longitudinal motion between the jack-screw 54 and the hold 122*a* in two horizontal planes as viewed in FIG. 4. The shouldered bushing 132*a* also includes a bearing flange portion 136*a* which is interposed between the lift nut 88*a* and the web 110*a*, the bearing flange portion 136*a* and the lift nut 88*a* being cumulatively sized to permit limited vertical motion between the lift nut 88*a* and the support-bar 84*a* as viewed in FIG. 6, it being understood that FIGS. 5 and 6 show the support-bar 84*a* lifted to the maximum of this limited vertical motion in opposition to gravity forces on the support-bar 84*a*.

It will be understood that the opposite ends of the support bars 84*a* carry lift nut 88*a* mounts and are identically configured.

Figure 7:
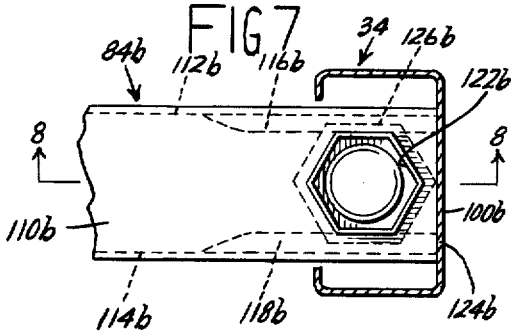
FIG 7 is a partial cross-section taken substantially as shown by section line 7—7 of FIG. 1.
Figure 8:
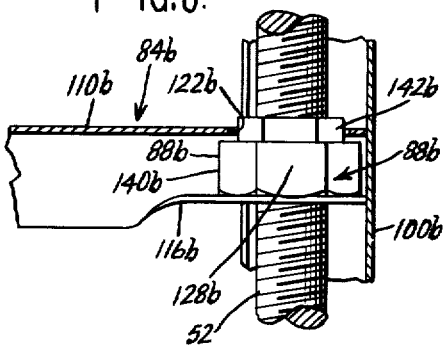
FIG. 8 is a partial cross-section taken substantially as shown by section line 8—8 of FIG. 7.

Referring now to FIGS. 7 and 8, in a second embodiment of the invention, using the supporting post 34 as examplary, it includes parts identical to those described in conjunction with the supporting post 36 of FIG. 4. The support-bar 84*b* of the FIG. 7 configuration includes an elongated web 110*b*, a pair of side flanges 112*b* and 114*b*, and a pair of inturned retaining flanges 116*b* and 118*b*. The retaining flanges 116*b* and 118*b* are formed only for a short length of the support-bar 84*b* proximal to an end 124*b* thereof.

A hexagonal hole 122*b* is formed in the web 110*b* proximal to the end 124*b*. A hexagonally shaped lift nut 88*b* is threaded onto the jack-screw 52 inserted into the support-bar 84*b* as shown. The lift nut 88*b* includes a pair of parallel sides 126*b* and 128*b* of a hexagonally shaped nut portion 140*b* which is in torque-engaging proximity to the side flanges 112*b* and 114*b* so that rotation of the lift nut 88*b* is effectively prevented. The lift nut 88*b* also includes a hexagonally shaped bushing body portion 142*b*. The height of the nut portion 140*b*, intermediate the web 110*b* and the flanges 116*b* and 118*b* is sized to permit relative vertical movement, as viewed in FIG. 8, between the lift nut 88*b* and the support-bar 84*b*, the support-bar 84*b* being shown as lifted against gravity to illustrate the vertical movement. In addition, the hexagonal bushing body portion 142*b* is sized with respect to the hexagonal hole 122*b* to permit limited relative, horizontal movement in two orthogonally intersecting axes, as viewed in FIG. 7, between the lift nut 88*b* and the support-bar 84*b*.

The total height of the lift nut 88*b*, as viewed in FIG. 8, including both the nut portion 140*b* and the bushing body portion 142*b*, is greater than the distance between the web 110*b* and the flanges 116*b* and 118*b*. Thus, in the embodiment of FIGS. 7 and 8, the flanges 116*b* and 118*b* are formed after the insertion of the bushing body portion 142*b* into the hole 122*b*.

The opposite ends of the support bars 84*b* carry lift nut 88*b* mounts and are identically configured.

Referring now to FIGS. 4, 5, 7, and 8, and for purposes of explaining the operation of both embodiments, if the support-bar 84*a* and the support-bar 84*b* are considered to be one continuous support-bar 84 interposed between the webs 100*a* and 100*b* of the support posts 36 and 34, respectively, then longitudinal motion is effectively minimized by the close spacing or very light sliding engagement between the upstanding web 100*a* and the end 124*a* and between the upstanding web 100*b* and the end 124*b*. However, the slot 42 of the post 36 is preferably wider than the distance across the flanges 112*a* and 114*a*; and the slot 42 of the post 36 is preferably wider than the distance across the flanges 112*b* and 114*b*.

Figure 9:
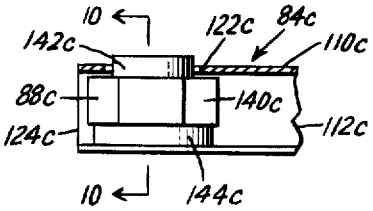
FIG. 9 is a partial cross-section taken substantially the same as FIG. 5 but with both the jack-screw and the vertically disposed supporting post removed.
Figure 10:
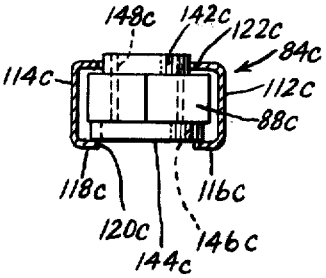
FIG. 10 is a partial cross-section taken substantially as shown by section line 10—10 of FIG. 9.

Referring now to FIGS. 9 and 10, in a third embodiment of the invention, a support-bar 84*c* includes an elongated web 110*c*, a pair of side flanges 112*c* and 114*c*, a pair of inturned retaining flanges 116*c* and 118*c* which are spaced apart to provide a slot 120*c* therebetween, and a hole 122*c* proximal to an end 124*c*.

A lift nut 88*c*, having a hexagonally shaped nut portion 140*c* and a cylindrically shaped bushing body portion 142*c* is installed into the support-bar 84*c* with the bushing body portion 142*c* being inserted with slight clearance through the hole 122*c*. The bushing body portion 142*c* is sized with respect to the hole 122*c* to allow relative horizontal movement in two orthogonally intersecting axes in the plane of the web 110*c*.

The total height of the lift nut 88*c*, as viewed in FIGS. 8 and 9, and including both the hexagonally shaped nut portion 140*c* and the bushing body portion 142*c*, is less than the space between the horizontal web 110*c* and the retaining flanges 116*c* and 118*c* so that the lift nut 88*c* can be installed into the support-bar 84*c* after the forming of the retaining flanges 116*c* and 118*c*.

A washer plate 144*c* is slidably installed intermediate retaining surface 130*c* of the lift nut 88*c* and the retaining flanges 116*c* and 118*c*. The washer plate 144*c* includes a hole 146*c*, which generally registers with threaded hole 148*c* of the lift nut 88*c*, which receives one of the jack-screws with clearance, the jack-screw threadedly fitting the lift nut 88*c*.

Figure 11:
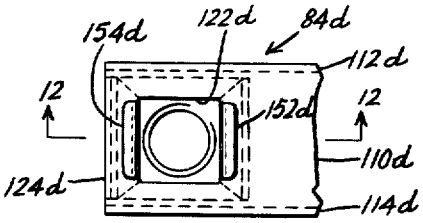
FIG. 11 is a partial top view taken substantially the same as FIG. 4 but with both the jack-screw and the vertically disposed supporting post removed.
Figure 12:
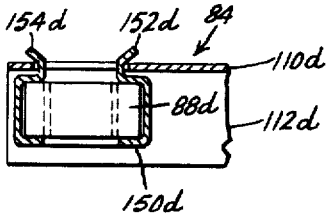
FIG. 12 is a partial cross-section taken substantially as shown by section line 12—12 of FIG. 11.

Referring now to FIGS. 11 and 12, in a fourth embodiment of the invention, a support-bar 84*d* includes an elongated web 110*d*, a pair of side flanges 112*d* and 114*d*, a rectangular hole 122*d* in the web 110*d* proximal to an end 124*d*.

A lift nut 88*d* is installed between the side flanges 112*d* and 114*d* and is retained therebetween by an attaching clip 150*d*. The attaching clip 150*d* is generally U-shaped fitting loosely around the lift nut 88*d* as shown in FIG. 12; and the attaching clip 150*d* includes a pair of hook-shaped attaching ears 152*d* and 154*d* which extend through and engage the opposite edges of rectangular hole 122*d*. The opposite sides of the hook-shaped ears 152*d* and 154*d*, respectively, are spaced apart distances greater than the thickness of the web 110*d* to permit limited relative vertical movement with respect to web 110*d*. Also, the ears 152*d* and 154*d* are of smaller dimensions than the hole 122*d* to permit limited relative horizontal movement with respect to bar 84*d*.

The bottom portion of the clip 150*d* conforms to the flat underside of nut 88*d* and is provided with an opening that clears the respective jack-screw received by nut 88*d*. The opposite sides of the clip 150*d* engage the flat sides, respectively, of nut 88*d* to prevent relative rotation, and enough clearance between the nut 88*d* and clip 150*d* is provided to permit squeezing the ears 152*d* and 154*d* toward each other to permit insertion into and withdrawal from the opening 122*d*. The resilience and preformed shape of the clip 150*d* causes the ears 152*d* and 154*d* to spring apart when inserted into opening 122*d* thereby assuring engagement with the edges of the opening 122*d* and retention of the clip and nut assembly on the support bar.

Figure 13:
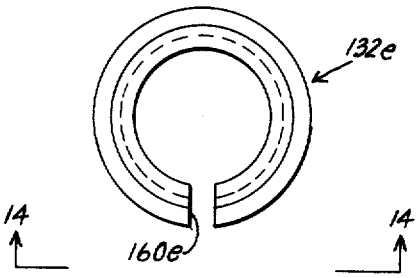
FIG. 13 is an enlarged top plan view of a shouldered bushing for use in the embodiment of FIGS. 4 - 6.
Figure 14:
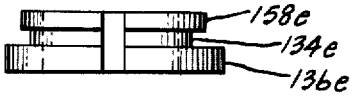
FIG. 14 is a fron elevation of the shouldered bushing of FIG. 13 taken substantially as shown by view line 14—14 of FIG. 13.

Referring now to FIGS. 13 and 14, a shouldered bushing 132*e* is provided for optional use in the configuration of FIGS. 4 – 6. The shouldered bushing 132*e* is preferably of plastic whereas the shouldered bushing 132*a* of FIGS. 4 – 6 is preferably of metal. The bushing 132*e* includes a body portion 134*e*, a bearing flange portion 136*e*, a retaining flange portion 158*e*, and a slot 160*e*. In operation, the bushing 132*e* may be compressed in outside diameter because of the slot 160*e* and the relative resiliency of the plastic material so that the retaining flange portion 158*e* may be installed through the hole 122*a* of the support-bar 84*a* from the inside of the support-bar 84, leaving the bearing flange portion 136*e* in the same position as is shown for the bearing flange portion 136*a* of the bushing 132*a*.

From the preceding description, it can be seen that the present invention provides means, including a pair of parallel spaced and horizontally disposed support-bars 84 and 86, for supportably attaching a typewriter platform to a plurality of jack-screws 52 – 58 to receive lifting motion therefrom, to allow limited vertical motion between the support-bars 84 and 86 and the jack-screws 52 – 58, and to permit limited relative horizontal movement between the support-bars 84 and 86 and the jack-screws 52 – 58 in two horizontal and orthogonally intersecting axes. It can be further be seen that the close position or very light sliding engagement of the ends 124*a* and 124*b* of the support-bar 84 and the upstanding webs 100*a* and 100*b* of the supporting posts 36 and 34 (also of bar 86 with respect to its parts) provide vertical guiding to minimize relative longitudinal movement between the support-bar and the supporting posts.

Therefore, the present invention provides a mechanism in which precise alignment and spacing of the support-bars and jack-screws is not required and yet in which excessive movement between a typewriter platform and a typewriter desk, due to inertial forces of returning the typewriter carriage, is effectively minimized.

The lift nuts all are assembled to the support-bars as described to have limited free-floating or universal movement such that any slight tilting of either or both of the support-bars, when attached to a rigid typewriter platform 94, will not inhibit the free vertical adjustment of this assembly on the jack-screws. This is particularly advantageous in the instance in which the platform may be slightly warped or have an uneven bottom surface such that rigidly securing the platform 94 onto the flat upper surfaces of the support-bars 84, 86 could cause the latter to tilt out of coplanar alignment. The floating action of the lift nuts accommodates this misalignment of the support-bars thus secured to the platform 94 without producing any binding engagement to the lift nuts with the jack-screws, whereby vertical adjustment of the platform remains free and easy.

While there have been described above the principles of this invention in connection with specific apparatus, it is to be clearly understood that this description is made only by way of example and not as a limitation to the scope of the invention.

What is claimed is:

1. An adjustable typewriter platform mechanism for use with a desk having a desk top with a typewriter platform recess, the mechanism comprising a horizontally disposed U-shaped base plate having two substantially parallel and elongated sides and having a cross-member interconnecting said sides;

means for fastening said base plate to said desk with said base plate being horizontally disposed below said desk top;

a plurality of vertically disposed jack-screws each having one end thereof rotatably journalled in said base plate for nontranslational rotation therein, being spaced both longitudinally along and transversely from a horizontal axis on said base plate, and each having the other end thereof rotatably journalled in said fastening means for notranslational rotation therein;

means, including a pair of parallel spaced and horizontally disposed support-bars, for supportably attaching a typewriter platform to said jack-screws to receive lifting motion therefrom, to permit limited vertical motion between said support-bars and said jack-screws, and to permit limited relative horizontal movement between said support-bars and said jack-screws in two horizontal and orthogonally intersecting axes; and means for simultaneously rotating all of said jack-screws.

2. The mechanism of claim 1 in which each of said support-bars includes an elongated web having two elongated edges, two side flanges that extend from respective ones of said elongated edges and a hole that extends transversely through said web proximal to one end of said support-bar and has a clearance with one of said jack-screws; and said attaching means comprises a lift nut threadably engaged with said one jack-screws and having a pair of parallel surfaces disposed inside said side flanges in torque engaging clearance therewith, and means for retaining said lift nut within a predetermined proximal clearance of said web.

3. The mechanism of claim 2 in which said lift nut includes a bottom surface parallel to and distal from said web; and said retaining means comprises two retaining flanges that extend inwardly from respective ones of said side flanges and engage said bottom surface.

4. The mechanism of claim 3 in which said attaching means further comprises a bushing having a body portion installed over said one jack-screw and inside said hole and is sized with said hole and said jack-screw to permit said relative horizontal movement, and having a bearing flange portion that is interposed between said web and said lift nut and is sized with said lift nut and with said support-bar to permit said limited vertical motion.

5. The mechanism of claim 4 in which said bushing is fabricated from plastic, includes a retaining flange portion distal from said bearing flange portion, and includes a slot through said bushing body portion and both of said flange portions.

6. The mechanism of claim 3 in which said lift nut includes a bushing body portion that is fitted over said one jack-screw, that is slidably fitted inside said hole, and that is sized with said hole to permit said horizontal movement.

7. The mechanism of claim 6 in which the overall dimension of said lift nut, from said bottom surface to the distal end of said bushing body portion is less than the inside dimension of said one support-bar from said web to said retaining flanges; and said attaching means includes a washer plate inserted between said one lift nut and said retaining flanges and having a hole slidably fitted over said one jack-screw.

8. The mechanism of claim 6 in which said hole and said bushing body portion are hexagonal in shape.

9. The mechanism of claim 3 in which said hole is rectangular in shape and said retaining means comprises an attaching clip secured to said one lift nut, extending through said hole, and movably engaging said web distal from said lift nut.

10. A typewriter desk of the type having a desk top, a knee opening under a portion of said desk top, a typewriter platform recess in said desk top generally corresponding in location to said knee opening, a horizontally disposed typewriter platform being generally disposed in said knee opening, a plurality of jack-screws each being vertically disposed and rotatably mounted to said desk below said desk top and proximal to said typewriter platform recess for nontranslational rotation, and a mechanism for simultaneously rotating all of said jack-screws, the improvement which comprises:

means for supportably attaching said typewriter platform to said jack-screws to receive lifting motion therefrom, to allow limited relative vertical motion between said typewriter platform and said jack-screws, and to permit limited relative horizontal movement between said typewriter platform and said jack-screws in two horizontal and orthogonally intersecting axes.

11. For use in an adjustable typewriter platform mechanism which includes a frame, a plurality of upright jack-screws rotably mounted on said frame, means for rotating said jack-screws in unison, elongated support-bars each operatively secured for vertical movement at the opposite ends thereof to two spaced jack-screws, said support-bars being channel shaped in cross-section, and a rigid typewriter-supporting platform secured to the support bars; the support-bars being secured to the jack-screws by means of mounting devices, each mounting device comprising a lift nut threaded onto a jack-screw and floatingly secured to an end of a support-bar whereby the support-bar may tilt by a predetermined amount without causing binding of the nut on the jack-screw, said lift nut being disposed between the flanges of the channel shaped support bar.

12. The mounting device of claim 11 in which the opposite ends of the support-bars have clearance openings with which the respective lift nuts are in registry and which receive the respective jack-screws therethrough.

13. The mounting devices of claim 12 in which each lift screw has an attaching clip secured thereto, said attaching clip being generally U-shaped formed about said nut and having a clearance opening in the bottom of the U-shape in registry with the threaded opening thereof, the ends of the U-shaped clip having opposed outwardly opening hook portions disposed on opposite sides of the jack-screw received by the lift nut, said hook portions movably engaging the opposite edges of the respective support-bar clearance opening which recieves the jack-screw thereby retaining the lift nut in assembly with the support-bar.

14. The mounting device of claim 13 in which the clearance openings in the support-bars are rectangular in shape, and said hook portions engaging opposed straight edges of the respective openings.

15. The mounting devices of claim 12 in which said lift nuts are retained within the respective support-bars by means of retaining flange portions inturned from the support-bar flanges, said retaining flange portions being spaced to receive with clearance therebetween the respective jack-screws.

16. The mounting devices of claim 15 in which each lift nut has a bushing portion loosely received by the respective support-bar clearance opening.

17. The mounting devices of claim 16 in which said bushing portion and clearance opening have complementary shapes including at least one flat side which prevents rotation of the lift nut with respect to the support-bar.

18. The mounting devices of claim 16 in which the height of the nut and bushing portion is less than the distance between the web of the support-bar and said retaining flange portions, a washer plate interposed between said nut and retaining flange portions, the thickness of said washer plate being sufficient to locate the bushing portion within the respective clearance opening.

* * * * *

UNITED STATES PATENT OFFICE

CERTIFICATE OF CORRECTION

Patent No. 3,938,766 Dated February 17, 1976

Inventor(s) Bruce E. Herbolsheimer, Douglas D. Marsh

It is certified that error appears in the above-identified patent and that said Letters Patent are hereby corrected as shown below:

Col. 2, line 19 "jace screws" should be -- jack screws --
Col. 2, line 67 "fron" should be -- front --
Col. 8, line 23 "to" should be -- of --

Claim 2, Col. 8, line 68 "jack screws" should be -- jack screw --

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*